US007670181B2

(12) United States Patent
Tu et al.

(10) Patent No.: US 7,670,181 B2
(45) Date of Patent: Mar. 2, 2010

(54) CONNECTOR FOR FIRST AND SECOND JOINTS HAVING DIFFERENT PIN QUANTITIES, ELECTRONIC APPARATUS WITH CONNECTOR AND COMBINATION

(75) Inventors: Chih-Wei Tu, Taoyuan County (TW); Yu-Jing Liao, Taoyuan County (TW); I-Cheng Chuang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 0 days.

(21) Appl. No.: 12/182,152

(22) Filed: Jul. 30, 2008

(65) Prior Publication Data

US 2008/0287007 A1 Nov. 20, 2008

Related U.S. Application Data

(63) Continuation-in-part of application No. 11/672,655, filed on Feb. 8, 2007, now Pat. No. 7,427,214.

(30) Foreign Application Priority Data

Mar. 20, 2006 (TW) ..... 95109410 A

(51) Int. Cl.
*H01R 13/648* (2006.01)

(52) U.S. Cl. ..... 439/607.01; 439/607.23; 439/660

(58) Field of Classification Search ..... 439/607.01, 439/607.23, 607.35, 607.36, 607.39, 660
See application file for complete search history.

(56) References Cited

U.S. PATENT DOCUMENTS 6,315,608 B1 * 11/2001 Lopata et al. ..... 439/607.36
7,128,608 B1 10/2006 Chen
7,128,617 B2 * 10/2006 Wang et al. ..... 439/660
7,165,989 B2 * 1/2007 Huang et al. ..... 439/346
7,318,752 B2 * 1/2008 Fujimoto et al. ..... 439/660
7,427,214 B2 * 9/2008 Liao et al. ..... 439/607.01
7,517,253 B1 * 4/2009 Chiang ..... 439/660

(Continued)

FOREIGN PATENT DOCUMENTS

CN 2572618 9/2003

(Continued)

OTHER PUBLICATIONS

"Search Report of European counterpart application", issued on Dec. 15, 2008, p. 1-p. 7.

*Primary Examiner*—Hae Moon Hyeon
(74) *Attorney, Agent, or Firm*—Jianq Chyun IP Office

(57) ABSTRACT

A connector and an electronic apparatus and a combination comprising the connector for first and second joints are disclosed. The connector includes a base, a plurality of first pins, and a plurality of second pins. The base has a first and a second connecting surface. The first pins are disposed on the first connecting surface and the quantity of the first pins is the same as the pin quantity of the first joint. In addition, the second pins are disposed on the second connecting surface and the total quantity of the second pins and the first pins is the same as the pin quantity of the second joint. The base may include two convex parts and a concave part. The first connecting surface and the second connecting surface are disposed on surfaces of the two convex parts respectively. The concave part accommodates the two convex parts.

23 Claims, 13 Drawing Sheets

U.S. PATENT DOCUMENTS

| | | | | |
|---|---|---|---|---|
| 7,537,489 | B2 * | 5/2009 | Iranpour Feridani et al. | 439/660 |
| 2005/0048846 | A1 | 3/2005 | Suzuki et al. | |
| 2007/0049119 | A1 | 3/2007 | Fujimoto et al. | |
| 2007/0218725 | A1 | 9/2007 | Liao et al. | |
| 2007/0218762 | A1 | 9/2007 | Liao et al. | |
| 2009/0124125 | A1 * | 5/2009 | Chatterjee | 439/607.05 |

FOREIGN PATENT DOCUMENTS

| | | |
|---|---|---|
| EP | 1274155 | 1/2003 |
| EP | 1860746 | 11/2007 |
| WO | 0176019 | 10/2001 |

* cited by examiner

800

CONNECTOR FOR FIRST AND SECOND JOINTS HAVING DIFFERENT PIN QUANTITIES, ELECTRONIC APPARATUS WITH CONNECTOR AND COMBINATION

CROSS-REFERENCE TO RELATED APPLICATION

This is a continuation-in-part application of patent application Ser. No. 11/672,655, filed on Feb. 8, 2007, which claims the priority benefit of Taiwan application serial no. 95109410, filed Mar. 20, 2006. The entirety of each of the above-mentioned patent applications is hereby incorporated by reference herein and made a part of this specification.

BACKGROUND OF THE INVENTION

1. Field of the Invention

The present invention relates to a connector, an electronic apparatus and in combination. More particularly, the present invention relates to a connector for a first and a second joint having different pin quantities and an electronic apparatus with the connector and in combination with the electronic apparatus and a device (such as an accessory).

2. Description of Related Art

Simple accessories, such as earphones, speakers, etc., are usually distinguished by different connectors for transmitting different data. The typical interface (or terminal) of a connector includes AV (Audio Video) joint, S-Video joint, USB joint, iLINK joint, earphone joint, and microphone joint etc. As to those hand-held devices, such as mobile phone, personal digital assistant (PDA), smart phone, player, game machine, or notebook PC, which are required to be light, thin, short, compact, and small, having connectors of various specs will increase not only the manufacturing cost but also the volumes thereof.

Universal serial bus (referred to as USB thereinafter) is currently broadly used as the interface for data transmission between an accessory and a host, and which is also a universal interface for transmitting data by using differential transmission technology. When an accessory is connected to a host through a USB transmission cord, the newly added hardware can be automatically detected through the USB terminal, and a suitable driving program for driving the accessory is searched for. Typical USB interfaces include 5-pin MINI A type male joint/female joint, 5-pin MINI B type male/female joint, and MINI AB female joint which is compatible to both MINI A and MINI B male joints.

Refer to FIG. 1, which illustrates that a plurality of USB pins 110 are arranged in parallel within a conventional MINI AB connector 100. It should be noted that since the quantity of the USB pins 110 is only 5, the connector 100 is only suitable for MINI A or MINI B connector (referring to FIG. 2 and FIG. 3), and the function thereof is limited. If the pin quantity of an accessory is different from the quantity of the USB pins 110, different connectors and transmission cords have to be installed to the host, accordingly, the manufacturing cost of the hand-held device and the volume thereof are increased.

SUMMARY OF THE INVENTION

Accordingly, the present invention is directed to provide a connector for a first and a second joint having different pin quantities, counts, amounts or numbers to improve compatibility between devices.

The present invention is also directed to provide an electronic apparatus with a connector for a first and a second joint having different pin quantities, counts, amounts or numbers to improve compatibility between devices.

The present invention is also directed to provide in combination including an electronic apparatus with a connector for a first and a second joint having different pin quantities, counts, amounts or numbers and at least one device having the first and/or the second joint to improve compatibility therebetween.

The present invention provides a connector for a first and a second joint. The connector includes a base, a plurality of first pins, and a plurality of second pins. The base has a first connecting surface and a second connecting surface. The base includes a first convex part, a second convex part and a concave part for accommodating the first convex part and the second convex part, wherein the first connecting surface and the second connecting surface are respectively disposed on two surfaces of the first convex part and the second convex part. The first pins are disposed on the first connecting surface and the quantity of the first pins is the same as the pin quantity of the first joint. The second pins are disposed on the second connecting surface and the total quantity of the first pins and the second pins is the same as the pin quantity of the second joint.

According to an embodiment of the present invention, the base further comprises two concave edge portions disposed at two corners of the concave part to form a fool-proof structure.

According to an embodiment of the present invention, a slot is formed between the first convex part, the second convex part and concave part for accommodating the first joint and the second joint.

According to an embodiment of the present invention, the first joint and the second joint comply with the specification of micro USB.

According to an embodiment of the present invention, the total quantity of the second and the first pins is 12. The total quantity of the first pins is 5. The total quantity of the second pins is 7.

According to an embodiment of the present invention, the first joint comprises a joint complying with the specification of micro A or micro B USB.

According to an embodiment of the present invention, the second joint comprises a 12-pin joint complying with the micro USB specification.

According to an embodiment of the present invention, the quantity of the first pins comprises the quantity of the pins complying with the specification of micro A or micro B USB.

According to an embodiment of the present invention, the foregoing second pins may include two identification pins, and the second joint is determined based on a voltage between the two identification pins.

According to an embodiment of the present invention, the second pins include a power output pin, and the second joint is determined based on a detected signal from the two identification pins.

According to an embodiment of the present invention, the first connecting surface faces the second connecting surface.

The present invention provides an electronic apparatus comprising a connector for a first and a second joint. The connector includes a base, a plurality of first pins, and a plurality of second pins. The base has a first connecting surface and a second connecting surface. The first connecting surface is disposed with the first pins, and the quantity of the first pins is the same as the pin quantity of the first joint. The second connecting surface is disposed with the second pins, and the total quantity of the second pins and the first pins is the same as the pin quantity of the second joint.

According to an embodiment of the present invention, the foregoing base includes a convex part and a concave part for accommodating the convex part, wherein the first connecting surface and the second connecting surface are respectively disposed on two opposite surfaces of the convex part. Meanwhile, a slot can be formed between the foregoing convex part and concave part for accommodating the first joint and the second joint. Moreover, the base may further comprise a concave edge portion disposed at a corner of the concave part to form a fool-proof structure.

According to an embodiment of the present invention, the foregoing base includes a first convex part, a second convex part and a concave part for accommodating the first convex part and the second convex part, wherein the first connecting surface and the second connecting surface are respectively disposed on two surfaces of the first convex part and the second convex part. Meanwhile, a slot can be formed between the first convex part, the second convex part and concave part for accommodating the first joint and the second joint. Moreover, the base may further comprise two concave edge portions disposed at two corners of the concave part to form a fool-proof structure. Furthermore, the first connecting surface may face the second connecting surface.

According to an embodiment of the present invention, the quantity of the first pins complies with micro A or micro B USB specification.

According to an embodiment of the present invention, the first joint and the second joint comply with the specification of micro USB.

According to an embodiment of the present invention, the total quantity of the second and the first pins is 11. The total quantity of the first pins is 5. The total quantity of the second pins is 6.

According to an embodiment of the present invention, the total quantity of the second and the first pins is 12. The total quantity of the first pins is 5. The total quantity of the second pins is 7.

According to an embodiment of the present invention, the foregoing second pins may include two identification pins, and the second joint is determined based on a voltage between the two identification pins.

According to an embodiment of the present invention, the second pins include at least an audio pin for transmitting audio signals between the electronic apparatus and an audio signal receiver when the audio signal receiver is connected to the electronic apparatus through the second joint. Moreover, the audio signal receiver could be selected from a group consisting of an earphone, a speaker and a microphone.

According to an embodiment of the present invention, the second pins include a power output pin for outputting power from the electronic apparatus to at least one device when the device is connected to the electronic apparatus through the second joint.

According to an embodiment of the present invention, the device is an electronic device installed with at least a micro processor or being a CPLD (complex programmable logic device).

The present invention provides in combination comprising at least one device and an electronic apparatus. The device has a first or a second joint. The electronic apparatus to which capable of connecting with the device comprises a connector for selectively connecting with the first or the second joint. The connector includes a base, a plurality of first pins, and a plurality of second pins. The base has a first connecting surface and a second connecting surface. The first connecting surface is disposed with the first pins, and the quantity of the first pins is the same as the pin quantity of the first joint. The second connecting surface is disposed with the second pins, and the total quantity of the second pins and the first pins is the same as the pin quantity of the second joint.

According to an embodiment of the present invention, the foregoing base includes a convex part and a concave part for accommodating the convex part, wherein the first connecting surface and the second connecting surface are respectively disposed on two opposite surfaces of the convex part. Meanwhile, a slot can be formed between the foregoing convex part and concave part for accommodating the first joint and the second joint. Moreover, the base may further comprise a concave edge portion disposed at a corner of the concave part to form a fool-proof structure.

According to an embodiment of the present invention, the foregoing base includes a first convex part, a second convex part and a concave part for accommodating the first convex part and the second convex part, wherein the first connecting surface and the second connecting surface are respectively disposed on two surfaces of the first convex part and the second convex part. Meanwhile, a slot can be formed between the first convex part, the second convex part and concave part for accommodating the first joint and the second joint. Moreover, the base may further comprise two concave edge portions disposed at two corners of the concave part to form a fool-proof structure. Furthermore, the first connecting surface may face the second connecting surface.

According to an embodiment of the present invention, the quantity of the first pins complies with micro A or micro B USB specification.

According to an embodiment of the present invention, the first joint and the second joint comply with the specification of micro USB.

According to an embodiment of the present invention, the total quantity of the second and the first pins is 11. The total quantity of the first pins is 5. The total quantity of the second pins is 6.

According to an embodiment of the present invention, the total quantity of the second and the first pins is 12. The total quantity of the first pins is 5. The total quantity of the second pins is 7.

According to an embodiment of the present invention, the foregoing second pins may include two identification pins, and the second joint is determined based on a voltage between the two identification pins.

According to an embodiment of the present invention, the device is with the second joint, the second pins of the connector include at least an audio pin for transmitting audio signals between the electronic apparatus and the accessory when the accessory is connected to the electronic apparatus through the second joint. Moreover, the accessory could be selected from a group consisting of an earphone, a speaker and a microphone.

According to an embodiment of the present invention, the device is with the second joint, the second pins of the connector include a power output pin for outputting power from the electronic apparatus to the accessory when the accessory is connected to the electronic apparatus through the second joint.

According to an embodiment of the present invention, the accessory is an electronic device installed with at least a micro processor or being a CPLD (complex programmable logic device).

According to an embodiment of the present invention, the accessory is a power charger.

In the present invention, a set of independent functional pins are added to the original connector structure so that external devices having different pin quantities can share the highly compatible connector structure. Accordingly, the connector and the electronic apparatus with the connector in the present invention can meet function expansion and power consumption accessory requirement and furthermore, can accomplish the purpose of connector sharing in product design.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
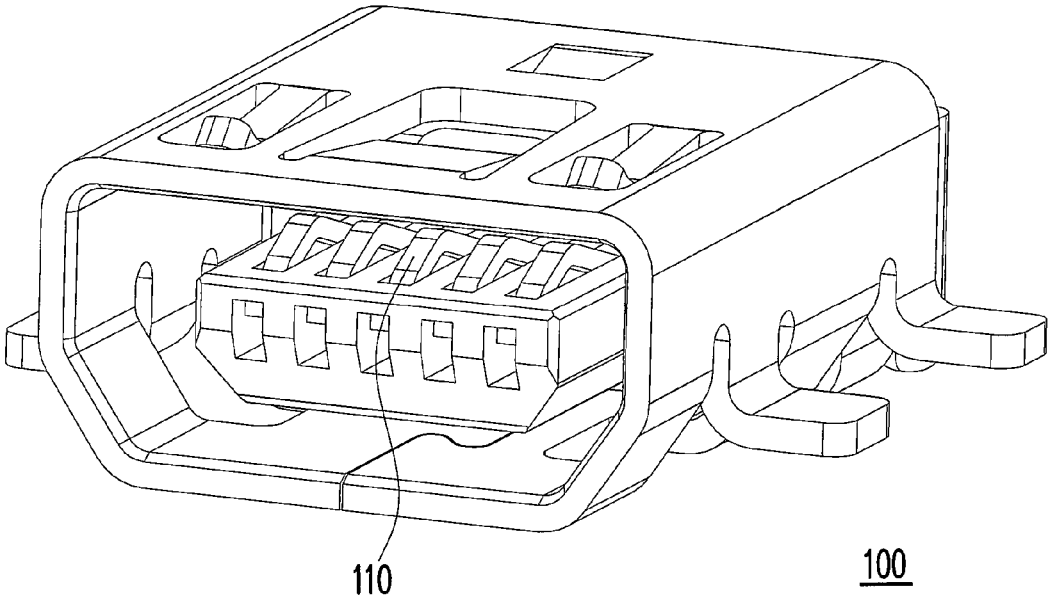
FIG. 1 (PRIOR ART)
FIG. 1 is a diagram illustrating that a plurality of USB pins are arranged in parallel within a conventional MINI AB connector.
Figure 2:
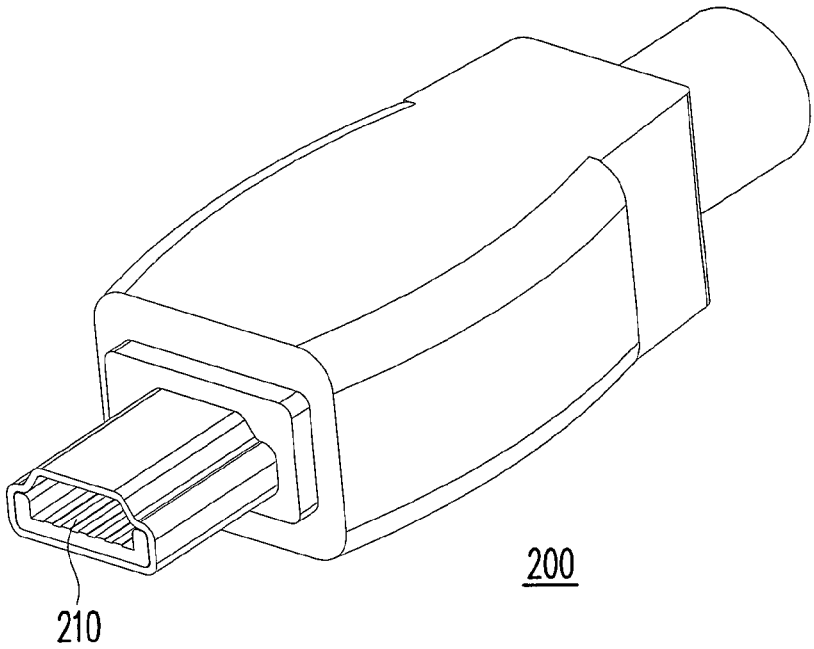
FIG. 2 (PRIOR ART)
FIG. 2 and FIG. 3 respectively illustrate conventional MINI A and MINI B male joint connectors.
Figure 3:
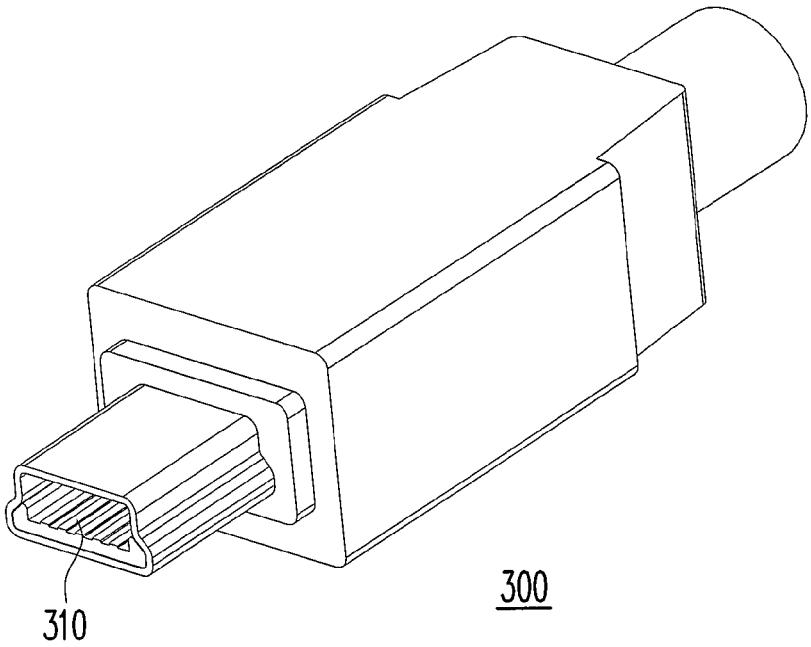
FIG. 3 (PRIOR ART)

FIG. 2 and FIG. 3 respectively illustrate conventional MINI A and MINI B male joint connectors. Referring to FIG. 2 and FIG. 3, the 5 USB terminals (or pins) 210 in FIG. 2 are disposed on the MINI A connector 200 and can be used for signal transmission, and the 5 USB terminals (or pins) 310 in FIG. 3 are disposed on the MINI B connector 300, but the sizes and patterns of the interfaces are slightly different for preventing misplug or reverse plug, which may cause misjudgment or failure. Besides, the MINI A connector 200 and the MINI B connector 300 are only suitable for respective male joint or female joint since the MINI A connector 200 and the MINI B connector 300 are designed to be fool-proof.

Figure 4:
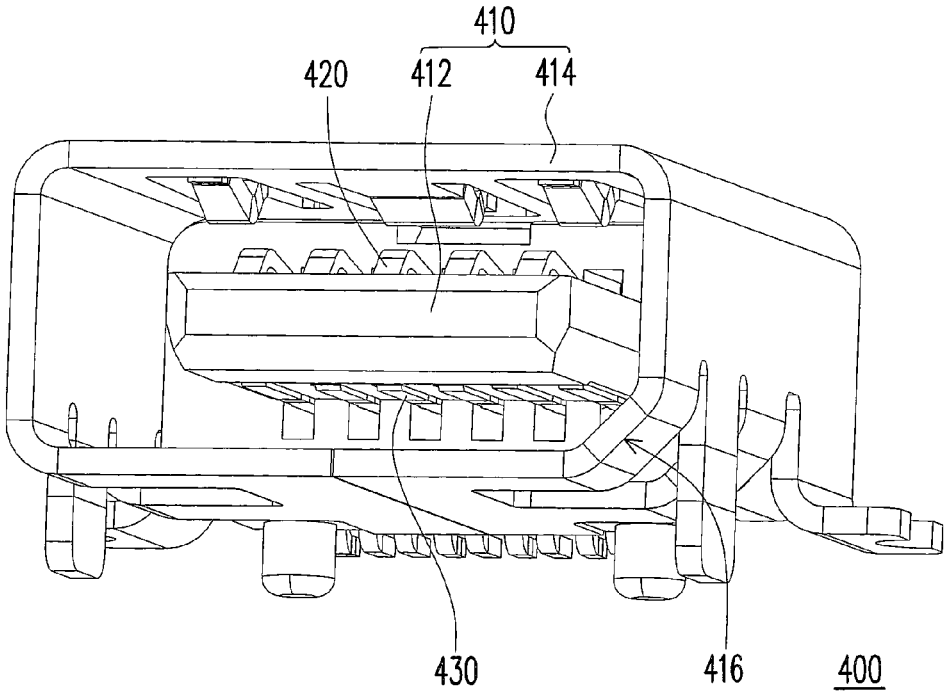
FIG. 4 is a diagram of a connector according to an embodiment of the present invention.
Figure 5:
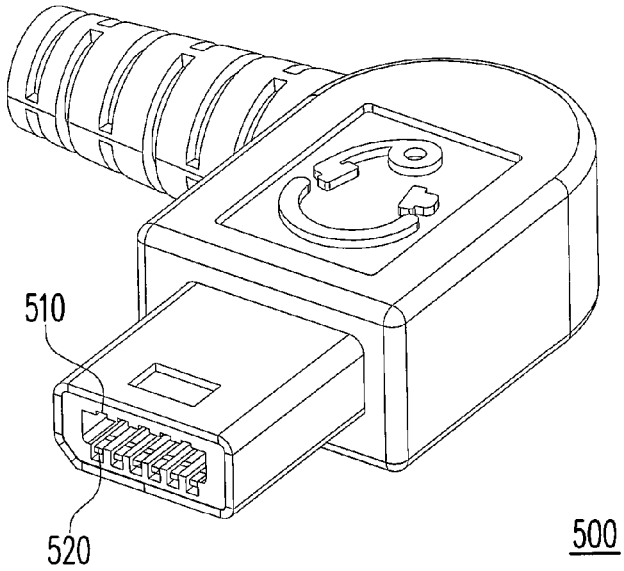
FIG. 5 illustrates a double-sided 11-pin male joint connector complying with USB specification which is suitable for the connector in FIG. 4.

FIG. 4 is a diagram of a connector 400 according to an embodiment of the present invention, and FIG. 5 illustrates a double-sided 11-pin male joint connector 500 complying with USB specification which is suitable for the connector in FIG. 4. Referring to FIG. 5, the difference of the connector 500 from the foregoing MINI A connector 200 and MINI B connector 300 is that the male joint connector 500 in FIG. 5 has 5 USB terminals (or pins) 510 located on the top surface of the interface and 6 USB terminals (or pins) 520 located on the bottom surface of the interface, and the total quantity of the terminals is 11. Wherein, the 5 USB terminals 510 on the top surface of the interface can be served as the first set of signal terminals, and the 6 USB terminals 520 on the bottom surface of the interface can be served as the second set of signal terminals. Since the quantity of the first set of signal terminals is the same as the quantity of the original MINI A or MINI B USB terminals, the first set of signal terminals can be used as the USB terminals of the original accessory and it is not necessary to change the circuit design thereof. The newly added second set of signal terminals can be used along with the first set of signal terminals as the USB terminals of the newly developed accessory for function expansion.

Referring to FIG. 4, to share the male joint having different USB terminals, the present invention provides a connector 400 including a base 410, a plurality of first pins 420, and a plurality of second pins 430. Wherein, the base 410 can be welded or assembled to an electronic apparatus (not shown), and the slot of the base 410 is used for accommodating a male joint having similar size to the slot, for example, the MINI A type connector 200 or the MINI B type connector 300 (first type joint), or the double-sided 11-pin male joint connector 500 (second type joint), so that the newly developed connector 400 can be suitable for different types of USB terminals.

As shown in FIG. 4, the base 410 includes a convex part 412 and a concave part 414 for accommodating the convex part 412, wherein a plurality of first pins 420 is disposed on the top surface of the convex part 412 and is arranged in a row to form a first connecting surface. Besides, a plurality of second pins 430 is disposed on the bottom surface of the convex part 412 and is arranged in a row to form a second connecting surface. The first connecting surface and the second connecting surface are stacked on two opposite surfaces. When the double-sided 11-pin male joint connector 500 is plugged into the slot formed by the convex part 412 and the concave part 414 of the base 410, the first pins 420 come into contact correspondingly with the terminals 510 at one side in the male joint connector 500 and are turned on, and the second pins 430 come into contact correspondingly with the terminals 520 at the other side in the male joint connector 500 and are turned on. If the MINI A connector 200 or the MINI B connector 300 is plugged into the slot of the base 410, only the first pins 420 come into contact correspondingly with the terminals of the connector 200 or 300 to be turned on while the second pins 430 are left unused. Accordingly, the quantity of the first pins 420 complies with the pin quantity specified for MINI A or MINI B USB, and the total quantity of the first pins 420 and the second pins 430 complies with the pin quantity specified for double-sided 11-pin USB, that is, the total quantity of the first pins 420 is 5, and the total quantity of the second pins 430 is 6, and the total pin quantity of the second joint (double-sided 11-pin USB) is greater than the total pin quantity of the first joint (MINI A or MINI B USB). Certainly, even though the quantities of the first pins 420 and the second pins 430 are explained in the present embodiment as example, they are not limited thereto.

Figure 6A:
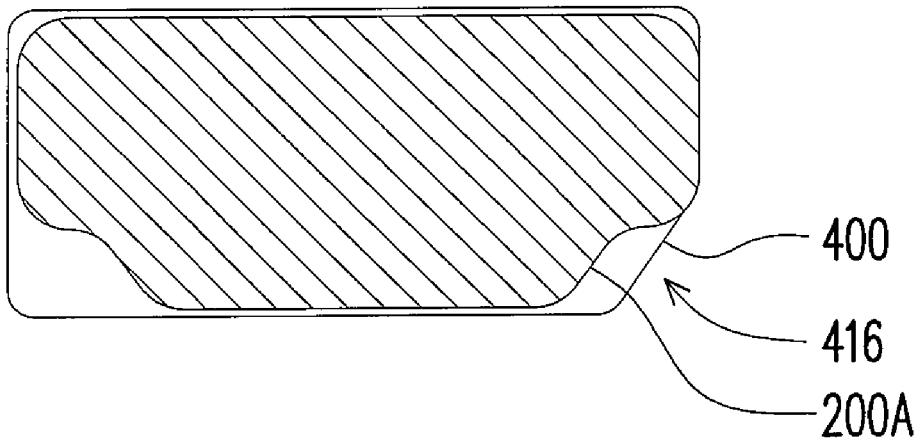
FIG. 6A and FIG. 6B are diagrams illustrating the front plug-in of a male joint and a female joint.
Figure 6B:
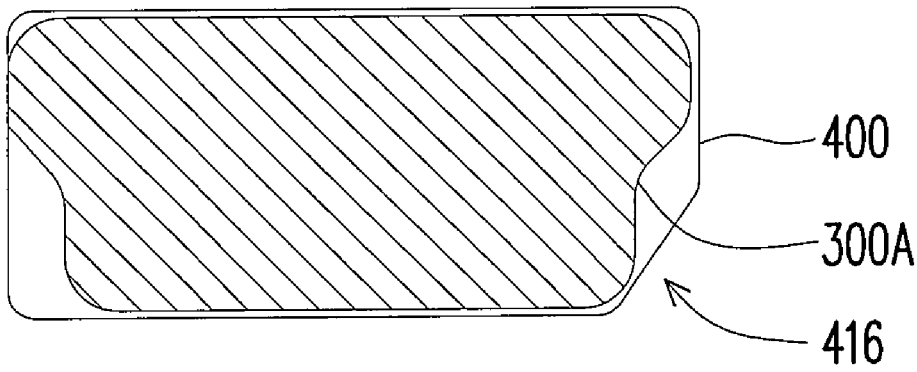
Figure 7A:
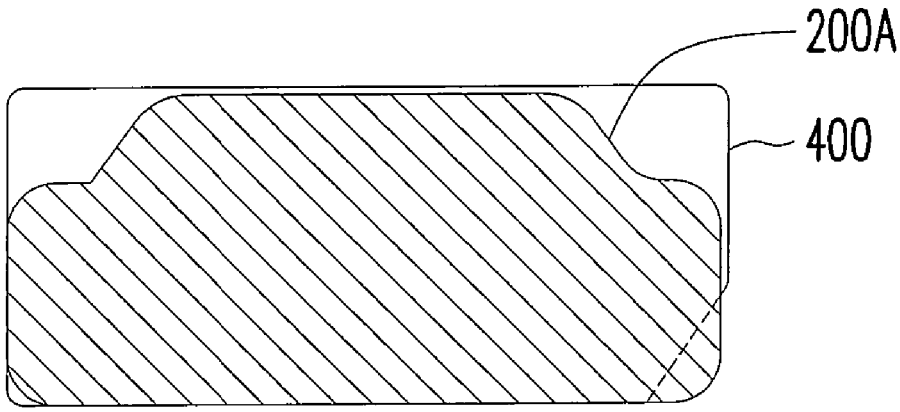
FIG. 7A and FIG. 7B are diagrams illustrating the back plug-in of a male joint and a female joint.
Figure 7B:
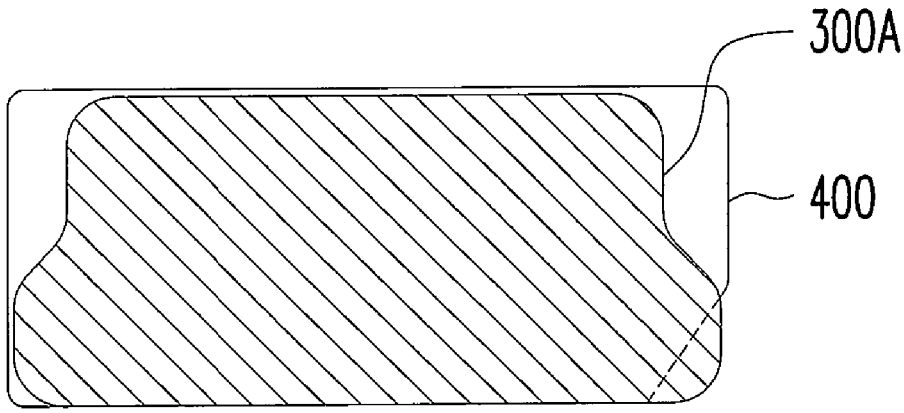

Refer to FIG. 6A and FIG. 6B, which are diagrams illustrating the correct plug-in of a male joint and a female joint, and FIG. 7A and FIG. 7B, which are diagrams illustrating the reverse plug-in of a male joint and a female joint. In the present embodiment, to prevent the MINI A male joint 200A or the MINI B male joint 300A from mistakenly contacting the second pins 430 of the connector 400 when the MINI A male joint 200A or the MINI B male joint 300A is plugged in reversely, the pattern of the connector 400 is designed to be fool-proof, that is, a concave edge portion 416 is designed for avoiding device failure or misjudgment. The MINI A male joint 200A in FIG. 6A and the MINI B male joint 300A in FIG. 6B can be correctly plugged into the double-sided 11-pin female joint connector 400, however, they cannot be reversely plugged into the double-sided 11-pin female joint connector 400 due to size prevention, as shown in FIG. 7A and FIG. 7B, so that the purpose of fool-proof can be achieved.

Figure 8A:
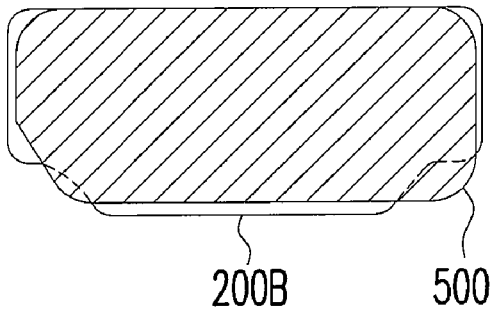
FIGS. 8A~8C are diagrams illustrating fool-proof when the male joint in the present invention is not suitable for the original MINI A, MINI B, and MINI AB female joints.
Figure 8B:
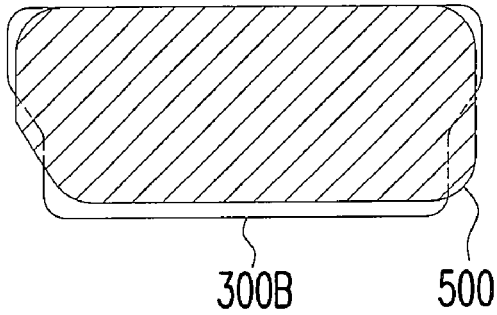
Figure 8C:
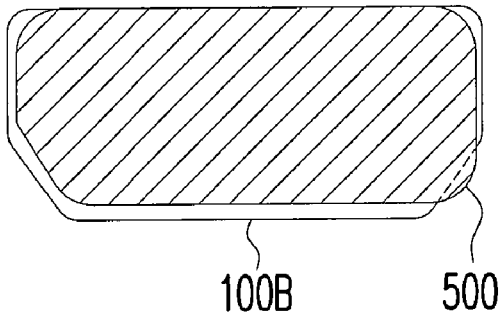

Next, refer to FIGS. 8A~8C, which are diagrams illustrating fool-proof when the double-sided 11-pin male joint connector 500 in the present invention is not suitable for the original MINI A, MINI B, and MINI AB female joints. To prevent the newly developed male joint 500 from being mistakenly plugged into the original female joint 200B, 300B, or 100B, the pattern of the male joint 500 is purposely designed different from the original female joints, so that the newly developed male joint 500 cannot be plugged into the original host, accordingly the male joint 500 is prevented from being turned on mistakenly and the purpose of fool-proof is achieved.

As described above, in the present invention, the connectors 400 and 500 keep the functions of the original 5-pin USB interface to be used by the original 5-pin MINI A and MINI B accessories, and the USB interface of the newly added 6 pins is for function expansion so that the connector 400 can be used by the newly developed accessory, that is, the total quantity of the first pins and the newly added second pins can be used by the second kind of accessory having higher pin quantity.

Since the newly added second pins 430 are disposed with at least one identification pin, the type of the second joint can be determined based on the voltage variations of the first identification voltage and the second identification voltage, that is, the pre-classified second joint is determined based on the configuration of short circuit status, impedance status, and open circuit status between the two wires for connecting the host and the second joint. In addition, the newly added second pins 430 can be further disposed a ground pin corresponding to the ground terminal of the second joint to produce a common ground terminal. Moreover, when the second joint is connected to an audio signal receiver, for example, earphone, speaker, microphone, or other multimedia electronic devices, the second pins are also disposed with at least one audio pin to transmit audio signals. The foregoing identification pin, ground pin, and audio pin can be arranged and combined based on the circuit design and will not be described in detail herein.

Figure 9:
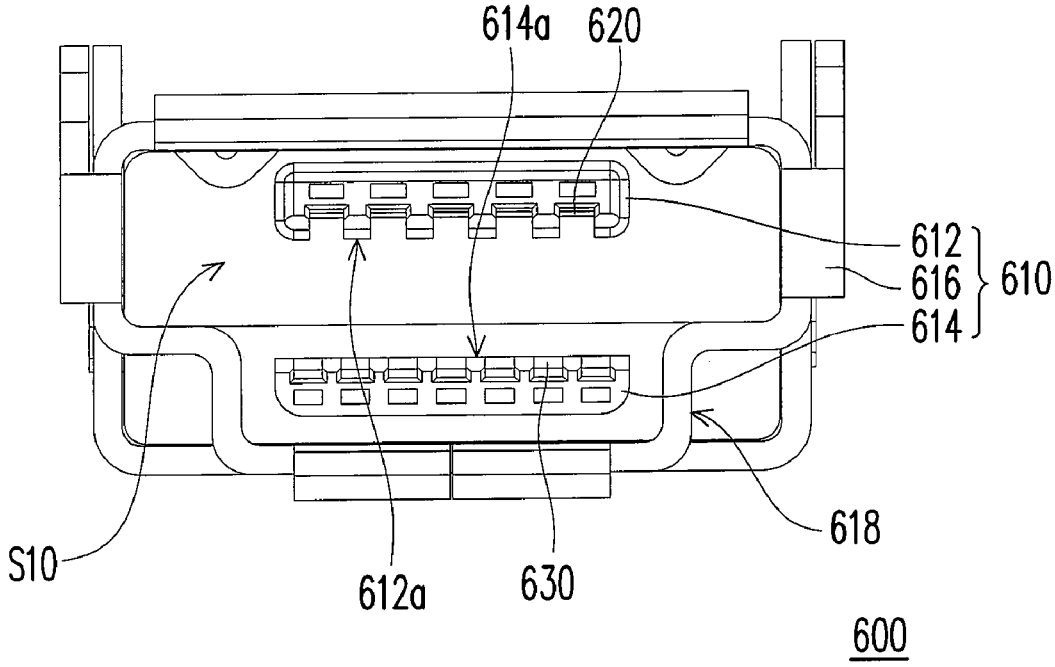
FIGS. 9-11 are diagrams in three viewpoints of a connector according to another embodiment of the present invention.
Figure 10:
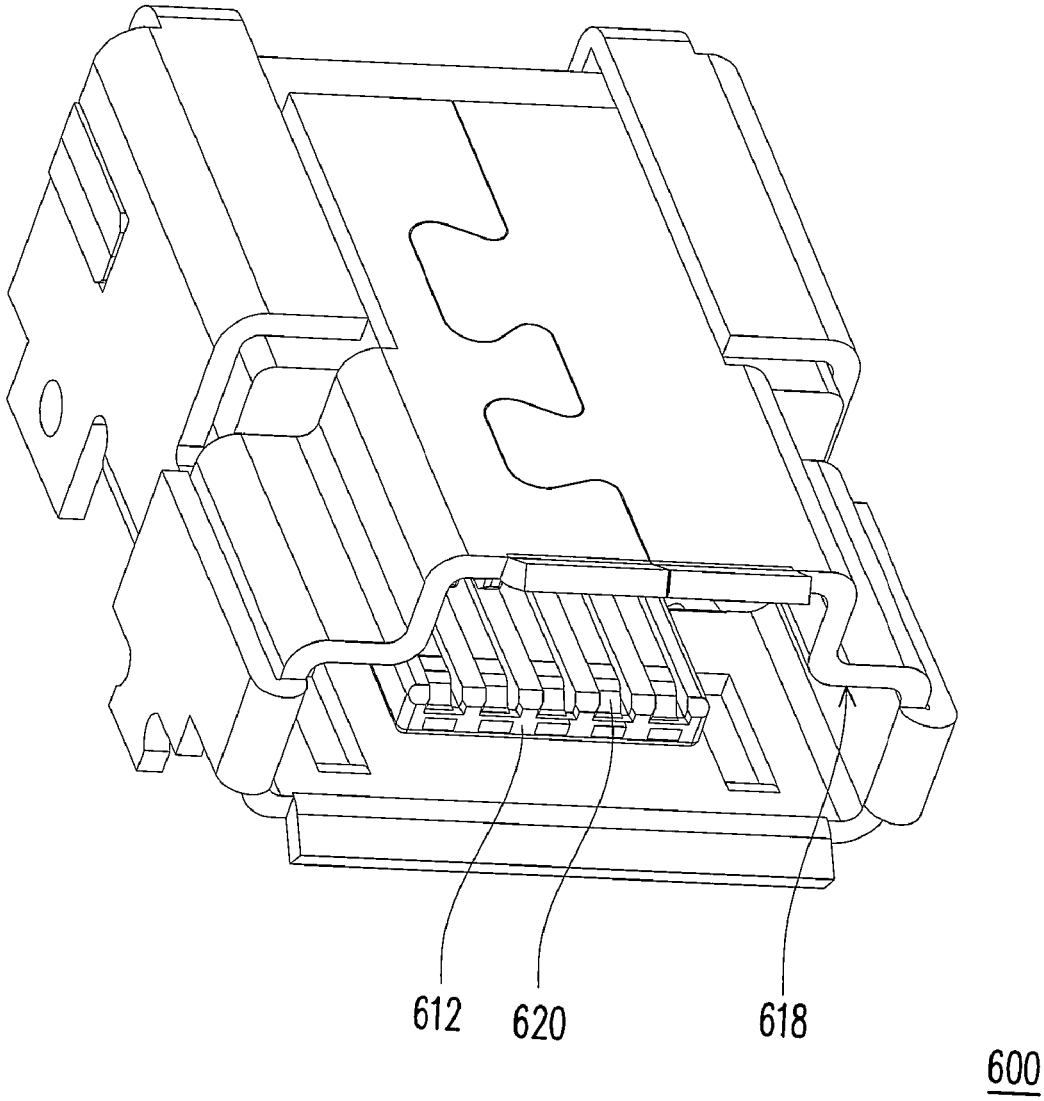
Figure 11:
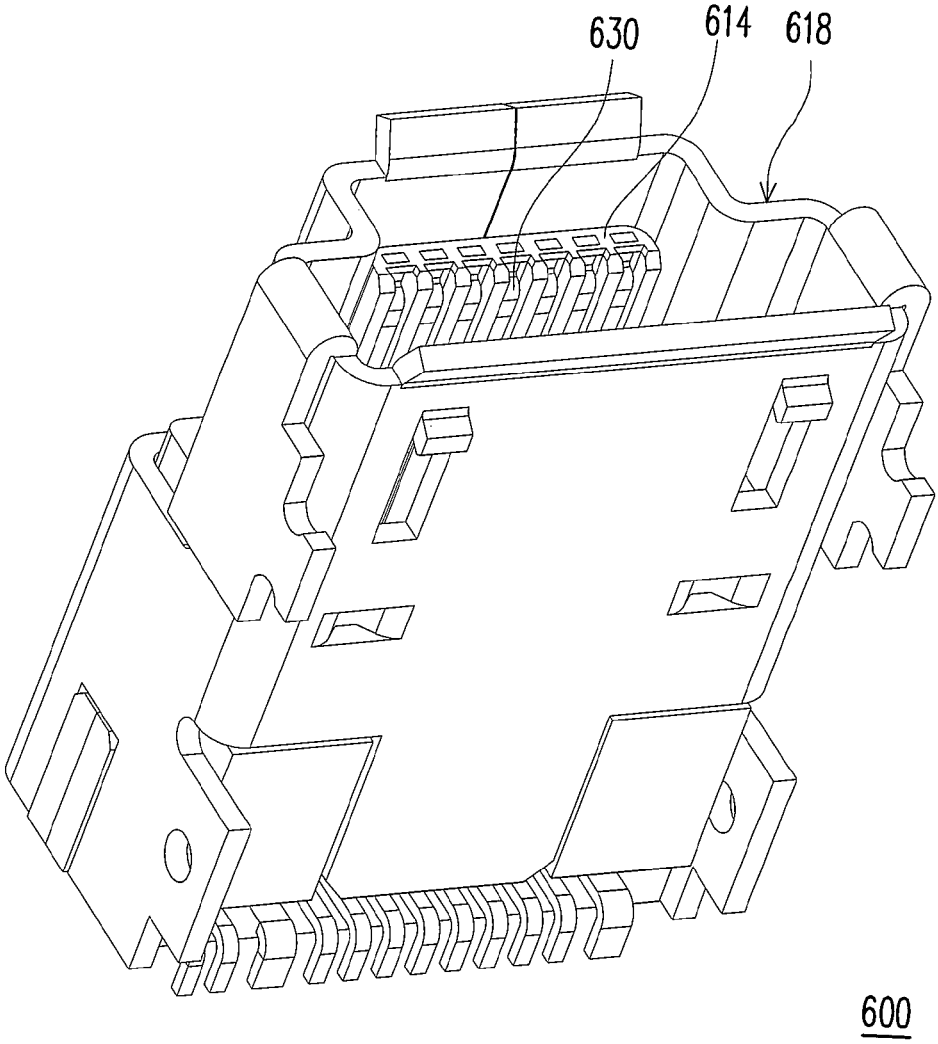

FIGS. 9-11 are diagrams in three viewpoints of a connector according to another embodiment of the present invention. Referring to FIGS. 9-11, the connector 600 includes a base 610, a plurality of first pins 620, and a plurality of second pins 630. The base 610 includes a first convex part 612, a second convex part 614 and a concave part 616 for accommodating the first convex part 612 and the second convex part 614. The first convex part 612 has a first connecting surface 612*a*, and the second convex part 614 has a second connecting surface 614*a*. The first pins 620 are disposed on the first connecting surface 612*a* and the quantity of the first pins 620 is the same as the pin quantity of the first joint (not shown). The first joint may comply with the specification of micro USB, such as the specification of micro A or micro B USB. The second pins 630 are disposed on the second connecting surface 614*a*. The total quantity of the first pins 620 and the second pins 630 is the same as the pin quantity of the second joint (not shown). The second joint may comply with the specification of micro USB, and the second joint may comprise a 12-pin joint complying with the micro USB specification. In this embodiment, the total quantity of the second pins 630 and the first pins 620 is 12, the total quantity of the first pins 620 is 5, and the total quantity of the second pins 630 is 7. Since the quantity of the first pins 620 is the same as the quantity of the original micro USB terminals, the first pins 620 can be used as the micro USB terminals of the original accessory and it is not necessary to change the circuit design thereof. The newly added second pins 630 can be used along with the first pins 620 as the micro USB terminals of the newly developed accessory for function expansion. Naturally, the connector 600 of this embodiment could comply with the specification of micro USB, standard USB or other specifications. Meanwhile, the quantity of the first pins comprises the quantity of the pins complying with the specification of micro A or micro B USB.

The pattern of the connector 600 can be designed to be fool-proof, that is, two concave edge portions 618 are designed at two corners of the concave part 616 for avoiding device failure or misjudgment caused by an incorrect plugging. A slot S10 is formed between the first convex part 612, the second convex part 614 and concave part 616 for accommodating the first joint and the second joint. Similar to the connector 400 of FIG. 4, the second pins 630 may include two identification pins, and the type of the second joint can be determined based on a voltage between the two identification pins. That is, the pre-classified second joint is determined based on the configuration of short circuit status, impedance status, and open circuit status between the two identification pins for connecting the host and the second joint. In addition, the newly added second pins 630 can be further disposed a ground pin corresponding to the ground terminal of the second joint to produce a common ground terminal. Moreover, when the second pins 630 are connected to an audio signal receiver, for example, earphone, speaker, microphone, or other multimedia electronic devices, the second pins 630 are also disposed with at least one audio pin to transmit audio signals (audio left or audio right). The second pins 630 can further include pins for audio microphone signal input and accessory power output. Specifically, the power output pin is capable of outputting power from the electronic apparatus to at least an accessory, when the accessory is coupled (plugged into) to the electronic apparatus through the second joint. Meanwhile, the two identification pins may catch a detected signal from the accessory to determine whether it needs more power. For an example, if the plugged accessory is an earphone, it is not necessary to provide more power to make it work. Thus, the electronic apparatus does not transmit any power to the accessory through the power output pin. Alternatively, if the plugged accessory is a newly developed remote control installed with a micro processor, it would need extra power provided from the apparatus to make it work. Of course, the more power is transmitted to the accessory through the power output pin. Thus, the second joint is determined based on the detected signal from the two identification pins. Furthermore, such power required accessory could be an electronic device installed with at least a micro processor or a CPLD (complex programmable logic device). Such devices require more extra power to comply with its desired function.

The newly 3C products, such as remote control, speaking cradle, docking station etc., are capable of connecting with the connector of this embodiment. The foregoing identification pin, ground pin, audio pin and pins for audio microphone signal input and accessory power output can be arranged and combined based on the circuit design and will not be described in detail herein. In this embodiment, the first connecting surface 612*a* faces the second connecting surface 614*a*.

Figure 12:
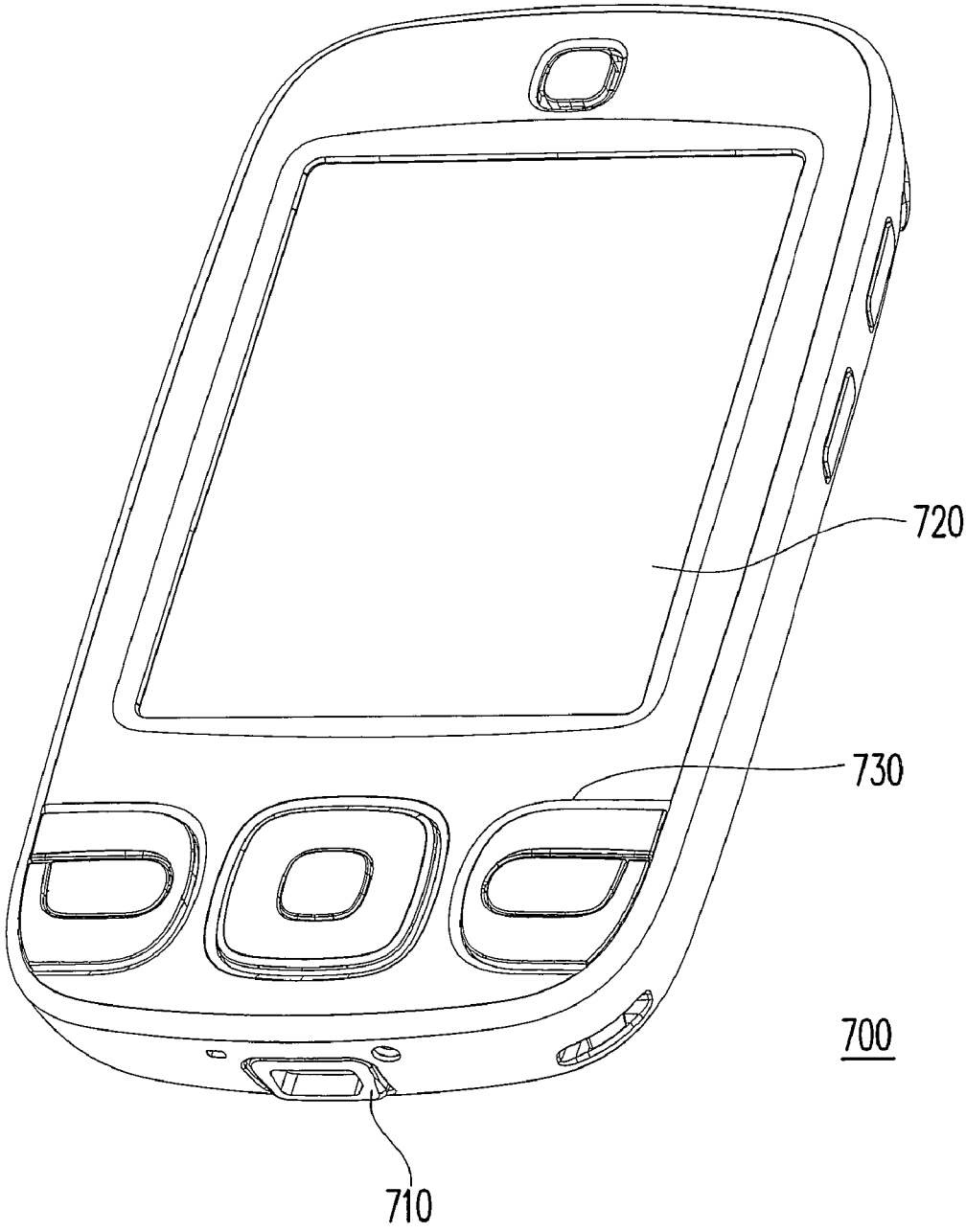
FIG. 12 is diagram of an electronic apparatus according to an embodiment of the present invention.

FIG. 12 is diagram of an electronic apparatus according to an embodiment of the present invention. Referring to FIG. 12, the electronic apparatus 700 of the embodiment comprising a compatible connector 710. The connector 710 could be the connector 400 shown in FIG. 4, the connector 600 shown in FIG. 9 or other connector of the present invention. Since the connector 710 added with second pins (such as the second pins in FIG. 9), the electronic apparatus 700 can be connected with the newly developed accessory for function expansion. The electronic apparatus 700 may further comprise a display 720 for showing the information and a keypad for data input.

Figure 13:
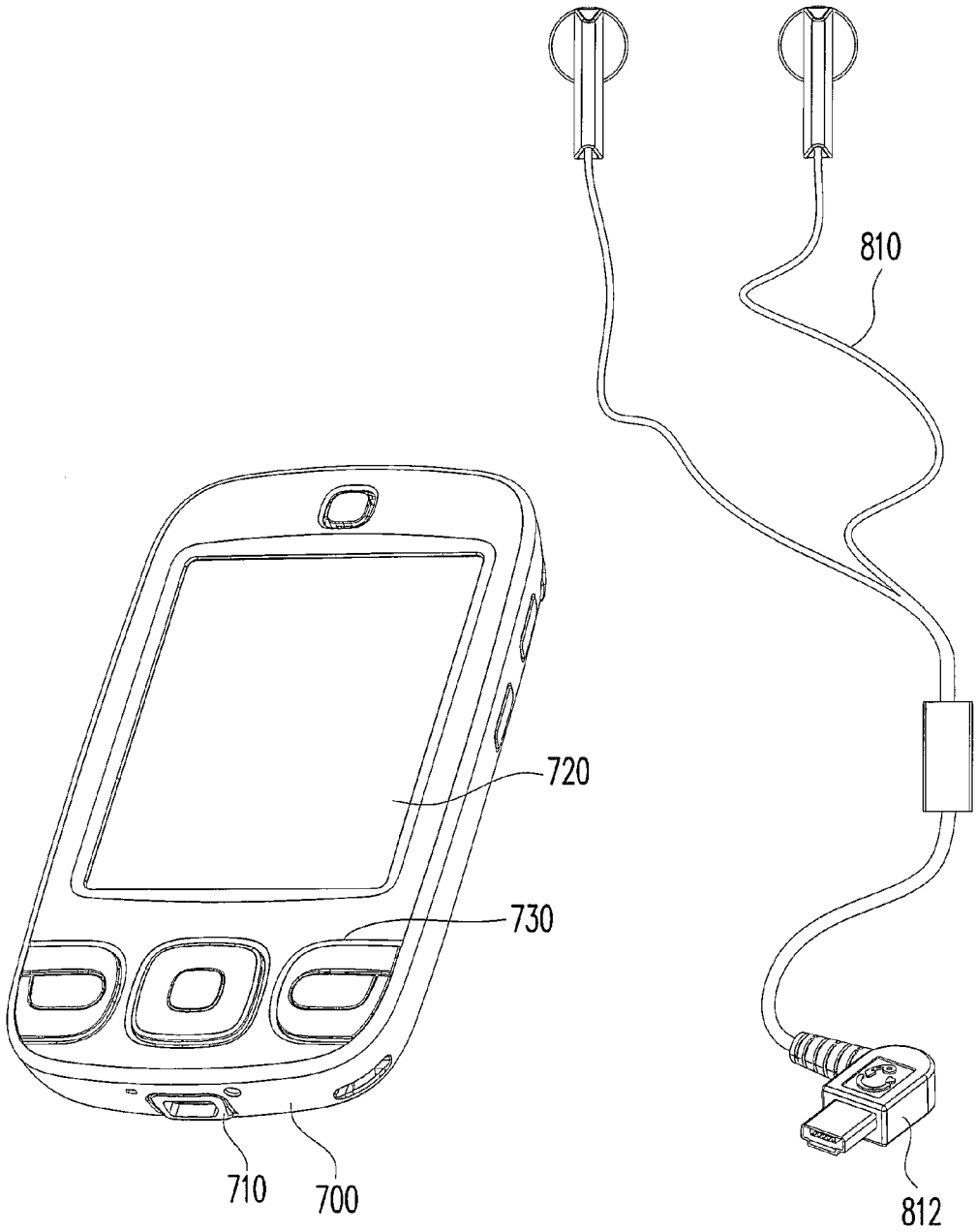
FIG. 13 is diagram of in combination with an electronic apparatus and at least one device according to an embodiment of the present invention.
Figure 14:
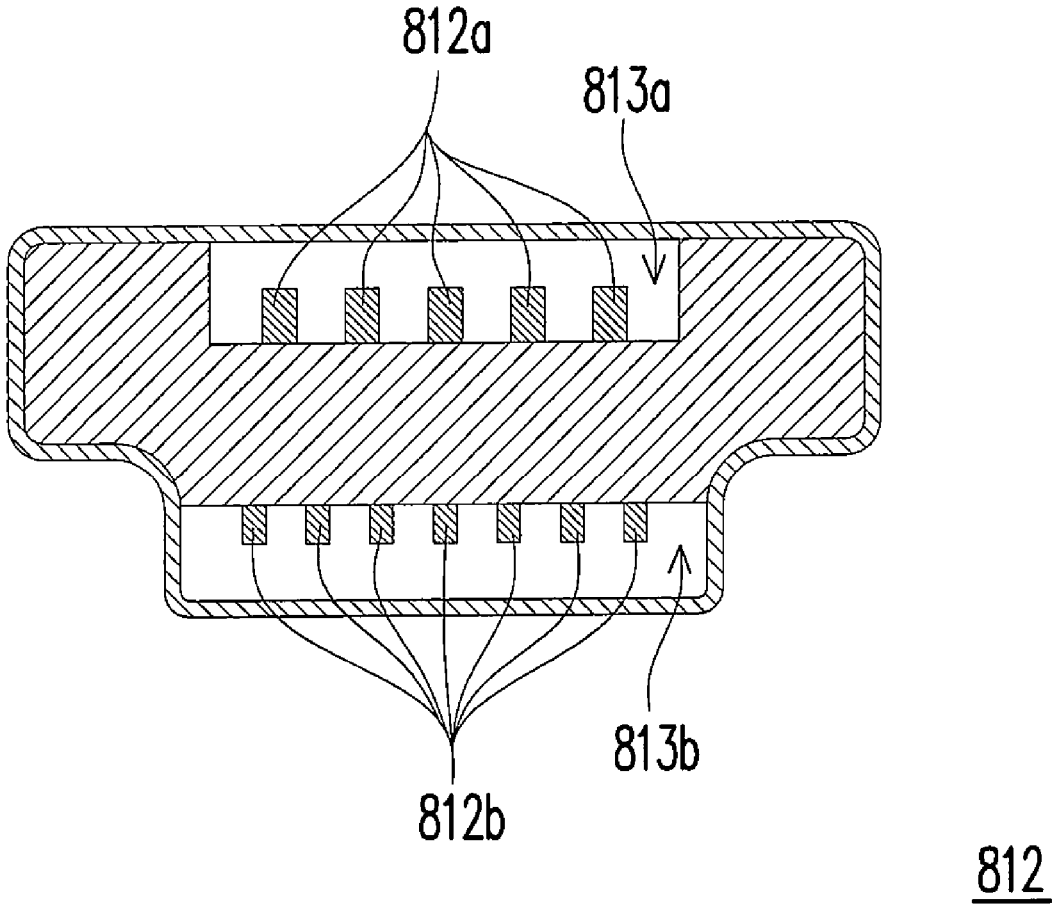
FIG. 14 is diagram for showing an enlarged front view of the second joint of the at least one device in FIG. 13.
Figure 15:
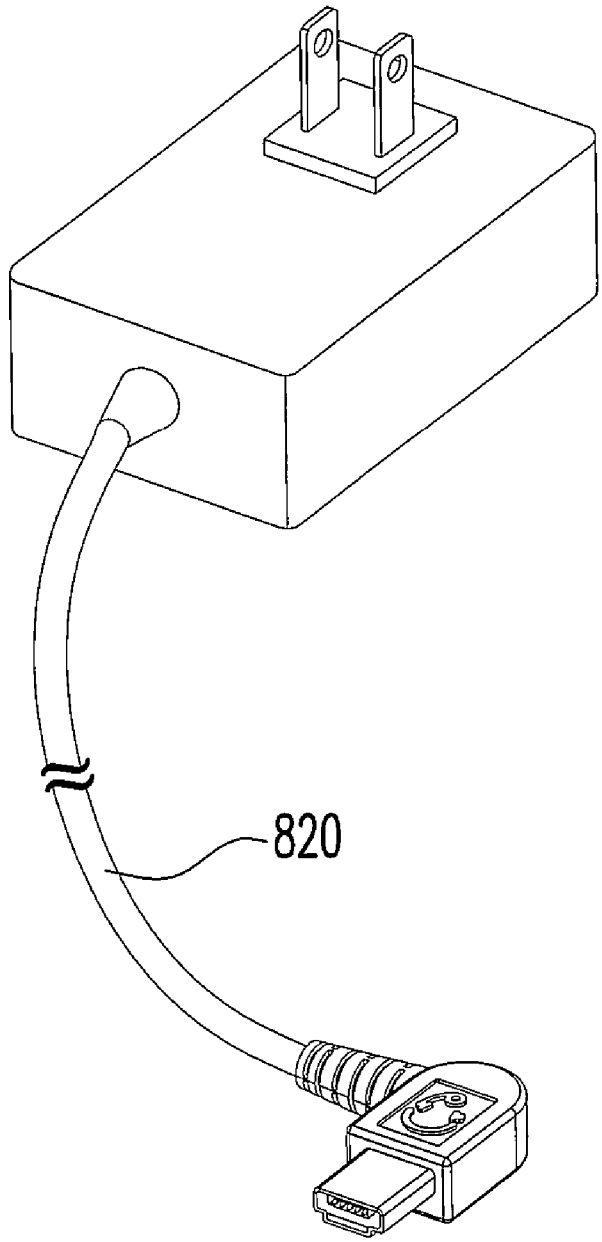
FIG. 15 is diagram of another device for combination in FIG. 13 according to another embodiment of the present invention.

FIG. 13 is diagram of in combination with an electronic apparatus and at least one device according to an embodiment of the present invention, and FIG. 14 is diagram for showing an enlarged front view of the second joint of the device in FIG. 13. Referring to FIGS. 13 and 14, the combination 800 of the embodiment comprising the electronic apparatus 700 (shown in FIG. 12) capable of connecting with the at least one device and at least one device 810 having a first joint (not shown) or a second joint (shown in FIG. 14). The device 810 in this embodiment is an earphone having a second joint 812. Generally, the device 810 can refer to the common accessory, such as earphone, power charger, cradle, cable etc. Referring to FIG. 14, there are two holes 813*a* and 813*b* formed within the second joint 812 and the total quantity of the pins could be 12. Specifically, five pins 812*a* are disposed inside the hole 813*a* and seven pins 812*b* are disposed inside the hole 813*b* of the second joint 812 shown in FIG. 14. When the second joint 812 of the device 810 (shown in FIG. 14) is inserted into the slot S10 of the connector 600 of the electronic apparatus (shown in FIG. 9), the hole 813*a* of the second joint 812 accommodates the first convex part 612 of the connector 600 and the hole 813*b* of the second joint 812 accommodates the second convex part 614 of the connector 600. Thus, five pins 812*a* are adapted to electrically contact with the first pins 620 and seven pins 812*b* are adapted to electrically contact with the second pins 630. Besides, the connector 600 of the electronic apparatus 700 is for selectively connecting with the first or the second joint. In another embodiment, the device 810 could be an electronic device installed with at least a micro processor or a CPLD, a speaker, a microphone, a power charger 820 (as shown in FIG. 15) or other kinds of accessories. Meanwhile, in another embodiment, the device 810 could have a first joint (not shown) instead of the second joint 812. The first joint could be micro A, micro B or other kinds of joints, and the total pin quantity of the first joint could be 5, for example. Since the connector 710 added with second pins (such as the second pins in FIG. 9), the electronic apparatus 700 can be connected with the newly developed device 810 having second joint or other accessories only having first joint for function expansion.

In overview, according to the present invention, a set of independent functional pins are added to the connector of the electronic apparatus so that the first and the second joints having different pin quantities can both use the highly compatible connector structure not only in mini USB but also in micro USB. Thus, the combination, the connector and the electronic apparatus of the present invention can meet function expansion and power consumption requirement, and furthermore, the purpose of connector sharing in product design can be accomplished.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector for a first and a second joint, comprising:

a base, having a first connecting surface and a second connecting surface, comprising:

a first convex part, wherein the first connecting surface is disposed on a surface of the first convex part;

a second convex part, wherein the second connecting surface is disposed on a surface of the second convex part; and a concave part, accommodating the first convex part and the second convex part; and a plurality of first pins, disposed on the first connecting surface, the quantity of the first pins being the same as the pin quantity of the first joint; and a plurality of second pins, disposed on the second connecting surface, the total quantity of the second pins and the first pins being the same as the pin quantity of the second joint, wherein the second pins include two identification pins, and the second joint is determined based on a voltage between the two identification pins.

2. The connector as claimed in claim 1, wherein the base further comprises two concave edge portions disposed at two corners of the concave part to form a fool-proof structure.

3. The connector as claimed in claim 1, wherein a slot is formed between the first convex part, the second convex part and the concave part for accommodating the first joint or the second joint.

4. The connector as claimed in claim 1, wherein the first joint and the second joint comply with the specification of micro USB (universal serial bus).

5. The connector as claimed in claim 1, wherein the first joint comprises a joint complying with the specification of micro A or micro B USB (universal serial bus).

6. The connector as claimed in claim 1, wherein the second joint comprises a 12-pin joint complying with the micro USB (universal serial bus) specification.

7. The connector as claimed in claim 1, wherein the quantity of the first pins comprises the quantity of the pins complying with the specification of micro A or micro B USB (universal serial bus).

8. The connector as claimed in claim 1, wherein the total quantity of the second pins and the first pins is 12, and the quantity of the first pins is 5, and the quantity of the second pins is 7.

9. The connector as claimed in claim 1, wherein the second pins include a power output pin, and the second joint is determined based on a detected signal from the two identification pins.

10. The connector as claimed in claim 1, wherein the first connecting surface faces the second connecting surface.

11. A combination of at least one device and an electronic apparatus, comprising:

the at least one device, having a first or a second joint; and the electronic apparatus having a connector for selectively connecting with the first or the second joint of the at least one device, wherein the connector comprises:

a base having a first connecting surface and a second connecting surface;

a plurality of first pins, disposed on the first connecting surface, the quantity of the first pins being the same as the pin quantity of the first joint; and a plurality of second pins, disposed on the second connecting surface, the total quantity of the second pins and the first pins being the same as the pin quantity of the second joint, wherein the second pins include two identification pins, and the second joint is determined based on a voltage between the two identification pins.

12. The combination as claimed in claim 11, wherein the base comprises:

a first convex part, wherein the first connecting surface is disposed on a surface of the first convex part;

a second convex part, wherein the second connecting surface is disposed on a surface of the second convex part; and a concave part, accommodating the first convex part and the second convex part.

13. The combination as claimed in claim 12, wherein the base further comprises two concave edge portions disposed at two corners of the concave part to form a fool-proof structure.

14. The combination as claimed in claim 12, wherein a slot is formed between the first convex part, the second convex part and the concave part for accommodating the first joint or the second joint.

15. The combination as claimed in claim 12, wherein the first connecting surface faces the second connecting surface.

16. The combination as claimed in claim 11, wherein the quantity of the first pins complies with the specification of micro A or micro B USB.

17. The combination as claimed in claim 11, wherein the first joint and the second joint comply with the specification of micro USB.

18. The combination as claimed in claim 11, wherein the total quantity of the second pins and the first pins is 12, and the quantity of the first pins is 5, and the quantity of the second pins is 7.

19. The combination as claimed in claim 11, wherein the device being with the second joint, the second pins of the connector include at least an audio pin for transmitting audio signals between the electronic apparatus and the device when the accessory is connected to the electronic apparatus through the second joint.

20. The combination as claimed in claim 11, wherein the device is selected from a group consisting of an earphone, a speaker and a microphone.

21. The combination as claimed in claim 11, wherein the device being with the second joint, the second pins of the connector include a power output pin for outputting power from the electronic apparatus to the device when the device is coupled to the electronic apparatus through the second joint.

22. The combination as claimed in claim 11, wherein the device is an electronic device installed with at least a micro processor or being a CPLD (complex programmable logic device).

23. The combination as claimed in claim 11, wherein the device is a power charger.

* * * * *